US007552825B2

(12) United States Patent
Caporrino

(10) Patent No.: US 7,552,825 B2
(45) Date of Patent: Jun. 30, 2009

(54) TOTE BAG FOR ORGANIZING, SECURING AND SAFELY TRANSPORTING LAUNDRY SUPPLIES

(76) Inventor: Romina V. Caporrino, 148-32 11th Ave., Whitestone, NY (US) 11357

( * ) Notice: Subject to any disclaimer, the term of this patent is extended or adjusted under 35 U.S.C. 154(b) by 210 days.

(21) Appl. No.: 11/508,483

(22) Filed: Aug. 23, 2006

(65) Prior Publication Data

US 2008/0047862 A1 Feb. 28, 2008

(51) Int. Cl.
*B65D 77/00* (2006.01)

(52) U.S. Cl. ..... 206/576; 206/499

(58) Field of Classification Search ..... 206/576, 206/499, 756, 216, 223, 775
See application file for complete search history.

(56) References Cited

U.S. PATENT DOCUMENTS

| | | | | | |
|---|---|---|---|---|---|
| 2,421,486 | A | * | 6/1947 | Dittmar | 206/499 |
| 3,432,025 | A | * | 3/1969 | Luhe | 206/545 |
| 3,872,966 | A | * | 3/1975 | Gordon et al. | 206/772 |
| 3,893,607 | A | * | 7/1975 | Jones | 206/576 |
| 4,094,351 | A | | 6/1978 | Catenaccio | |
| 4,463,789 | A | | 8/1984 | Leiserson | |
| 4,506,769 | A | | 3/1985 | Franco et al. | |
| 5,050,998 | A | | 9/1991 | Wachtel | |
| 5,458,278 | A | | 10/1995 | Laconte | |
| 5,503,476 | A | | 4/1996 | Hamdan | |
| 5,690,217 | A | * | 11/1997 | Friday | 206/278 |
| 5,992,630 | A | * | 11/1999 | Brown et al. | 206/497 |
| 6,276,525 | B1 | * | 8/2001 | Kobeluch et al. | 206/315.1 |
| 6,336,552 | B1 | * | 1/2002 | Meier | 206/3 |
| 6,659,273 | B1 | * | 12/2003 | Scola | 206/285 |
| 6,761,367 | B2 | | 7/2004 | Fite | |

* cited by examiner

*Primary Examiner*—Jacob K Ackun, Jr.
(74) *Attorney, Agent, or Firm*—Richard L. Miller

(57) ABSTRACT

A tote bag for organizing, securing and safely transporting laundry supplies which comprises a box-shaped housing having a bottom wall, a pair of side walls, a rear wall and a lower front wall. A flap can be folded over to cover a top and an upper front portion area of the box-shaped housing. A plurality of box-shaped laundry supply containers are sized and proportioned so that they can fit within the box-shaped housing in a side-by-side relationship to utilize almost the entire confines of the box-shaped housing without any appreciable left over wasted space therein. A mechanism is for securing all of the box-shaped laundry supply containers snugly within the box-shaped housing. When the flap is opened and the securing mechanism is removed therefrom all of the box-shaped laundry supply containers can be easily taken out of the box-shaped housing.

7 Claims, 1 Drawing Sheet

DETERGENT
BLEACH
SOFTENER

TOTE BAG FOR ORGANIZING, SECURING AND SAFELY TRANSPORTING LAUNDRY SUPPLIES

BACKGROUND OF THE INVENTION

1. Field of the Invention

The present invention relates generally to a laundry bag, and more particularly, a tote bag for organizing, securing and safely transporting laundry supplies.

2. Description of the Prior Art

Numerous innovations for storage apparatuses have been provided in the prior art that will be described. Even though these innovations may be suitable for the specific individual purposes to which they address, however, they differ from the present invention.

A FIRST EXAMPLE, U.S. Patent Office Document No. 4,094,351, Issued on Jun. 13, 1978, to Catenaccio teaches a bag in which laundry can be carried by a person between the person's home and a laundry washing machine. The bag being of canvas is attached to a shoulder strap so to be slung over a shoulder. A top flap of the bag has rope loops attached thereupon in the shape of a ship steering wheel, the loops being engagable with knots around the bag mouth. Compartments inside the bag are for white or plain laundry items. Air vent holes are around the bag side. Several short feet on an underside of the bag are for supporting it off a possibly wet floor of a laundry room. An end of the shoulder strap has a utility bag secured thereto for carrying soap powder items and magazines.

A SECOND EXAMPLE, U.S. Patent Office Document No. 4,463,789, Issued on Aug. 7, 1984, to Leiserson teaches an equipment bag particularly designed for use with a video camera and characterized by an internal open-topped pouch generally semi-circularly shaped with a Velcro patch on one side which mates at any desirable position along another Velcro patch mounted on one or both of the internal surfaces of the sidewalls of the body of the bag. The pouch is intended to hold video accessories and ordinarily would lie inside the bag alongside the lens of the camera, which is narrower than the camera body. Other salient features include a specialized four-way opening zippered top, a tripod holder and a comfortable shoulder strap with a built-in shock cord feature.

A THIRD EXAMPLE, U.S. Patent Office Document No. 4,506,769, Issued on Mar. 26, 1985, to Franco et al. teaches an activity bag system that includes an outer carrying bag, multiple interchangeable inner containers carried one-at-a-time within the outer bag, and a container storage cover for each inner container which also serves as a partition for the outer carrying bag. Each inner container is divided by partitions into compartments for carrying the items needed for a particular sport or activity. At least some of the compartments are covered by a lid to which some items can be secured. The outer bag includes a lower section which receives the inner container and an upper lid section separated from the lower section by the inner container's storage cover. The inner container is placed within its storage cover when not being carried by the outer bag. The outer bag includes straps for securing large items to its outside surface and outside storage pockets, including an insulated pocket for carrying a container of hot or cold liquid.

A FOURTH EXAMPLE, U.S. Patent Office Document No. 5,050,998, Issued on Sep. 24, 1991, to Wachtel teaches a dual laundry bag having a front panel, a rear panel and a center panel which divides the dual laundry bag into two or more compartments. The top of the dual laundry bag includes a drawstring closure and a pair of grommets. The bottom of each compartment includes a zipper closure which facilitates discharging each compartment individually. The rear panel includes a pair of adjustable carrying straps and the front panel includes a flap and an adjustable belt for attachment of clothing which has been hung on hangers to the dual laundry bag.

A FIFTH EXAMPLE, U.S. Patent Office Document No. 5,458,278, Issued on Oct. 17, 1995, to LaConte teaches a bag for carrying articles, particularly articles to be laundered. A compartment is provided having an interior and an opening to provide access to the interior. A fastener, such as a zipper, extends along the length of the compartment. The fastener, when opened, expands the opening to provide greater access to the interior. A drawstring is secured about a periphery of the compartment at the opening to adjust the size of the opening. At least one strap is integrally formed with the compartment to assist in maneuvering the compartment. Additional compartments or pockets are provided separate from the other compartment for carrying other articles, such as articles associated with the laundering process. The bag is particularly suited for carrying over at least one or both shoulders of an individual.

A SIXTH EXAMPLE, U.S. Patent Office Document No. 5,503,476, Issued on Apr. 2, 1996, to Hamdan teaches an apparatus for presorting laundry having a pair of laundry compartments easily accessible to the user. The apparatus includes a closure panel for closing the compartments. The closure panel includes an aperture in which an object can be received for hanging the laundry apparatus. Alternatively, a hanger can be received in loops attached to the apparatus for allowing the apparatus to be hung over a door knob, laundry cart and the like. The apparatus can include a plurality of pockets for holding various laundry related objects.

A SEVENTH EXAMPLE, U.S. Patent Office Document No. 6,761,367 B2, Issued on Jul. 13, 2004, to Fite teaches a laundry hamper assembly. A hamper, having a bottom floor and a top portion, features a container disposed in its top portion. The container and the bottom floor define a cavity for storing articles of clothing. The container in the hamper is configured to hold laundry supplies. Ventilation grills are defined in the hamper between the container and the bottom floor, allowing air to flow from the cavity to the outside of the hamper. Other elements improve the mobility of the hamper assembly, and secure the contents of both the hamper and its containers.

It is apparent now that numerous innovations for storage apparatuses have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a tote bag for organizing, securing and safely transporting laundry supplies that avoids the disadvantages of the prior art.

ANOTHER OBJECT of the present invention is to provide a tote bag for organizing, securing and safely transporting laundry supplies that is simple and inexpensive to manufacture.

STILL ANOTHER OBJECT of the present invention is to provide a tote bag for organizing, securing and safely transporting laundry supplies that is simple to use.

BRIEFLY STATED, STILL YET ANOTHER OBJECT of the present invention is to provide a tote bag for organizing, securing and safely transporting laundry supplies which comprises a box-shaped housing having a bottom wall, a pair of side walls, a rear wall and a lower front wall. A flap has a rear edge integral with a top edge of the rear wall of the box-shaped housing. The flap can be folded over to cover a top and an upper front portion area of the box-shaped housing. A plurality of box-shaped laundry supply containers are sized and proportioned so that they can fit within the box-shaped housing in a side-by-side relationship to utilize almost the entire confines of the box-shaped housing without any appreciable left over wasted space therein. A mechanism is for securing all of the box-shaped laundry supply containers snugly within the box-shaped housing. When the flap is opened and the securing mechanism is removed therefrom all of the box-shaped laundry supply containers can be easily taken out of the box-shaped housing. A strap is attached at opposite ends to the side walls of the box-shaped housing, so as to allow a person to safely transport the box-shaped laundry supply containers within the box-shaped housing, when the securing mechanism is in place and the flap is closed.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALLING OF REFERENCE NUMERALS UTILIZED IN THE DRAWING

Figures 1, 2, 3:
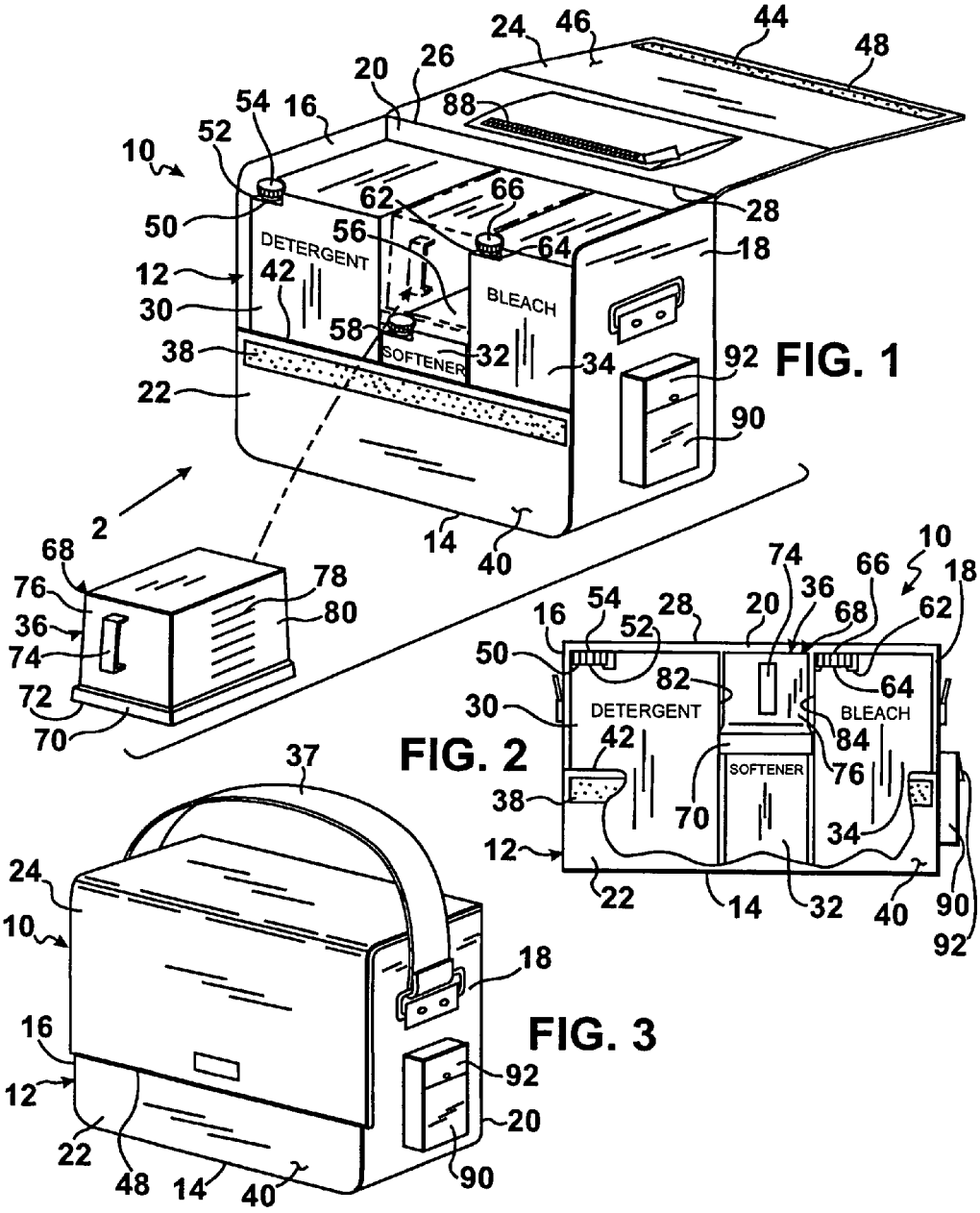
FIG. 1 is a diagrammatic perspective view of the present invention with the flap opened and the strap removed, showing the detergent container, fabric softener container and the bleach container placed therein, with the measuring cup for the fabric softener container exploded therefrom.
FIG. 2 is a front elevational view taken in the direction of arrow 2 in FIG. 1, with parts broken away, showing the flap folded back out of sight.
FIG. 3 is a diagrammatic perspective view of the present invention with the flap in a closed position and the strap installed thereon.

10 tote bag
12 box-shaped housing of tote bag 10
14 bottom wall of box-shaped housing 12
16 first side wall of box-shaped housing 12
18 second side wall of box-shaped housing 12
20 rear wall of box-shaped housing 12
22 lower front wall of box-shaped housing 12
24 flap of tote bag 10
26 rear edge of flap 24
28 top edge of rear wall 20
30 first box-shaped container of tote bag 10
32 second box-shaped container of tote bag 10
34 third box-shaped container of tote bag 10
36 securing mechanism of tote bag 10
37 strap of tote bag 10
38 first VELCRO® strip of tote bag 10
40 front surface of lower front wall 22
42 top edge of lower front wall 22
44 second VELCRO® strip of tote bag 10
46 rear surface of flap 24
48 free edge of flap 24
50 recessed top corner of first box-shaped laundry supply container 30
52 threaded neck on recessed top corner 50
54 closure cap on threaded neck 52
56 top wall of second box-shaped laundry supply container 32
58 threaded neck on top wall 56
60 closure cap on threaded neck 58
62 recessed top corner of third box-shaped laundry supply container 34
64 threaded neck on recessed top corner 62
66 closure cap on threaded neck 64
68 box-shaped measuring cup of securing mechanism 36
70 raised lip on box-shaped measuring cup 68
72 mouth of box-shaped measuring cup 68
74 handle of box-shaped measuring cup 68
76 first side wall of box-shaped measuring cup 68
78 scale of box-shaped measuring cup 68
80 second side wall of box-shaped measuring cup 68
82 left side wall of first box-shaped container 30
84 right side wall of third box-shaped container 34
86 money holder pocket of tote bag 10
88 zipper of money holder pocket 88
90 cell phone holder of tote bag 10
92 snap lid of cell phone holder 90

DETAILED DESCRIPTION OF THE PREFERRED EMBODIMENT

Referring now to the figures, in which like numerals indicate like parts, and particularly to FIGS. 1 through 3, which are a diagrammatic perspective view of the present invention with the flap opened and the strap removed, showing the detergent container, the fabric softener container and the bleach container placed therein, with the measuring cup for the fabric softener container exploded therefrom; a front elevational view taken in the direction of arrow 2 in FIG. 1, with parts broken away, showing the flap folded back out of sight; and a diagrammatic perspective view of the present invention with the flap in a closed position and the strap installed thereon, and as such, will be discussed with reference thereto.

The present invention is a tote bag 10 for organizing, securing and safely transporting laundry supplies which comprises a box-shaped housing 12 having a bottom wall 14, a pair of side walls 16, 18, a rear wall 20 and a lower front wall 22. A flap 24 has a rear edge 26 integral with a top edge 28 of the rear wall 20 of the box-shaped housing 12. The flap 24 can be folded over to cover a top and an upper front portion area of the box-shaped housing 12.

A plurality of box-shaped laundry supply containers 30, 32, 34 are sized and proportioned so that they can fit within the box-shaped housing 12 in a side-by-side relationship to utilize almost the entire confines of the box-shaped housing 12 without any appreciable left over wasted space therein. A mechanism 36 is for securing all the box-shaped laundry supply containers 30, 32, 34 snugly within the box-shaped housing 12. When the flap 24 is opened and the securing mechanism 36 is removed therefrom, all of the box-shaped laundry supply containers 30, 32, 34 can be easily taken out of the box-shaped housing 12. A strap 37 is attached at opposite ends to the side walls 16, 18 of the box-shaped housing 12, so as to allow a person to safely transport the box-shaped laundry supply containers, 30, 32, 34 within the box-shaped housing 12, when the securing mechanism 36 is in place and the flap 24 is closed.

A first VELCRO® strip 38 is affixed to a front surface 40 near a top edge 42 of the lower front wall 22 of the box-shaped housing 12. A second VELCRO® strip 44 is affixed to a rear surface 46 near a free edge 48 of the flap 24. When the flap 24 is folded closed over the top and upper front portion area of the box-shaped housing 12, the second VELCRO® strip 44 will engage with the first VELCRO® strip 38 to hold the flap 24 in a retained closed position. It is to be noted that VELCRO® is a well known trademark for hook and loop pile fastener material.

The first box-shaped laundry supply container 30 is for holding detergent and is of a height slightly lower than the side walls 16, 18 and the rear wall 20 of the box-shaped housing 12. The second box-shaped laundry supply container 32 is for holding fabric softener and is a height of about half that of the first box-shaped laundry supply container 30, but higher than the lower front wall 22 of the box-shaped housing 12. The third box-shaped laundry supply container 34 is for holding bleach and is the same height as the first box-shaped laundry supply container 30.

The first box-shaped laundry supply container 30 has a recessed top corner 50 with a threaded neck 52 and a closure cap 54. The second box-shaped laundry container 32 has a top wall 56 with a threaded neck 58 and a closure cap 60. The third box-shaped laundry container 34 has a recessed top corner 62 with a threaded neck 64 and a closure cap 66.

The securing mechanism 36, as best seen in FIG. 1, comprises a box-shaped measuring cup 68 having a raised lip 70 extending about its mouth 72, a handle 74 upon a first side wall 76 of the box-shaped measuring cup 68 and a scale 78 upon a second side wall 80 of the box-shaped measuring cup 68. When the box-shaped measuring cup 68 is inverted and placed upon the top wall 56 of the second box-shaped laundry supply container 32 within the box-shaped housing 12, the raised lip 70 will bear against a left side wall 82 of the first box-shaped laundry supply container 30 and a right side wall 84 of the third box-shaped laundry-supply container 34 to retain all of the box-shaped laundry supply containers 30, 32, 34 snugly within the box-shaped housing 12 (see FIG. 2).

The tote bag 10, as shown in FIG. 1, further comprises a money holder pocket 86 attached to the rear surface 46 of the flap 24. A zipper 88 is for closing the money holder pocket 86. A cell phone holder 90 is attached to the side wall 18 of the box-shaped housing 12. A snap lid 92 is for closing the cell phone holder 90.

The way of organizing, securing and safely transporting laundry supplies in the tote bag 10 comprises the steps of:

1. Inserting the first box-shaped laundry supply container 30 that holds detergent within a left side of the box-shaped housing 12 of the tote bag 10.

2. Inserting the second box-shaped laundry supply container 32 that holds a fabric softener within center of the box-shaped housing 12 of the tote bag 10 next to the first box-shaped laundry supply container 30, wherein the second box-shaped laundry supply container 32 is of a height about half that of the first box-shaped laundry supply container 30.

3. Inserting the third box-shaped laundry supply container 34 that holds bleach within a right side of the box-shaped housing 12 of the tote bag 10 next to the second box-shaped laundry supply container 32, wherein the third box-shaped laundry supply container 34 is the same height as the first box-shaped laundry supply container 30.

4. Placing the box-shaped measuring cup 68 having the raised lip 70 extending about its mouth 72 in an inverted position onto the second box-shaped laundry supply container 32, so that the raised lip 70 will bear against the left side wall 82 of the first box-shaped laundry supply container 30 and the right side wall 84 of the third box-shaped laundry supply container 34 to retain all of the box-shaped laundry supply containers 30, 32, 34 snugly within the box-shaped housing 12 of the tote bag 10.

5. Closing the flap 24 of the tote bag 10 over a top and upper front portion area of the box-shaped housing 12.

6. Grasping the strap 37 attached at opposite ends to the side walls 16, 18 of the box-shaped housing 12 of the tote bag 10 to allow a person to safely transport the box-shaped laundry supply containers 30, 32, 34 within the box-shaped housing 12 of the tote bag 10.

It will be understood that each of the elements described above, or two or more together, may also find a useful application in other types of constructions differing from the types described above.

While the invention has been illustrated and described as embodiments of a tote bag for organizing, securing and safely transporting laundry supplies, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A tote bag for organizing, securing and safely transporting laundry supplies which comprises:

a) a box-shaped housing having a bottom wall, a pair of side walls, a rear wall and a lower front wall;

b) a flap having a rear edge integral with a top edge of said rear wall of said box-shaped housing, whereby said flap can be folded over to cover a top and an upper front portion area of said box-shaped housing;

c) a plurality of box-shaped laundry supply containers sized and proportioned so that they can fit within said box-shaped housing in a side-by-side relationship to utilize most of the confines of said box-shaped housing without any appreciable left over wasted space therein;

d) means for securing all of said box-shaped laundry supply containers snugly within said box-shaped housing, wherein when said flap is opened and said securing means is removed therefrom all of said box-shaped laundry supply containers can be easily taken out of said box-shaped housing;

e) a strap attached at opposite ends to said side walls of said box-shaped housing, so as to allow a person to safely transport said box-shaped laundry supply containers within said box-shaped housing, when said securing means is in place and said flap is closed;

f) a first hook and loop pile fastener material strip affixed to a front surface near a top edge of said lower front wall of said box-shaped housing;

g) a second hook and loop pile fastener material strip affixed to a rear surface near a free edge of said flap, wherein when said flap is folded closed over the top and upper front portion area of said box-shaped housing, said second hook and loop pile fastener material strip will engage with said first hook and loop pile fastener material strip to hold said flap in a retained closed position;

h) a first box-shaped laundry supply container is for holding detergent and is of a height slightly lower than said side walls and said rear wall of said box-shaped housing;

i) a second box-shaped laundry supply container is for holding fabric softener and is a height of about half that of said first box-shaped laundry supply container but higher than said lower front wall of said box-shaped housing;

j) said third box-shaped laundry supply container is for holding bleach and is the same height as said first box-shaped laundry supply container;

k) said first box-shaped laundry supply container having a recessed top corner with a threaded neck and a closure cap;

l) said second box-shaped laundry supply container having a top wall with a threaded neck and a closure cap; and m) said third box-shaped laundry supply container having a recessed top corner with a threaded neck and a closure cap.

2. The tote bag as recited in claim 1, further comprising:

a) a money holder pocket attached to said rear surface of said flap; and b) a zipper for closing said money holder pocket.

3. The tote bag as recited in claim 1, further comprising:

a) a cell phone holder attached to one said side wall of said box-shaped housing; and b) a snap lid for closing said cell phone holder.

4. A tote bag for organizing, securing and safely transporting laundry supplies which comprises:

a) a box-shaped housing having a bottom wall, a pair of side walls, a rear wall and a lower front wall;

b) a flap having a rear edge integral with a top edge of said rear wall of said box-shaped housing, whereby said flap can be folded over to cover a top and an upper front portion area of said box-shaped housing;

c) a plurality of box-shaped laundry supply containers sized and proportioned so that they can fit within said box-shaped housing in a side-by-side relationship to utilize most of the confines of said box-shaped housing without any appreciable left over wasted space therein;

d) means for securing all of said box-shaped laundry supply containers snugly within said box-shaped housing, wherein when said flap is opened and said securing means is removed therefrom all of said box-shaped laundry supply containers can be easily taken out of said box-shaped housing;

e) a strap attached at opposite ends to said side walls of said box-shaped housing, so as to allow a person to safely transport said box-shaped laundry supply containers within said box-shaped housing, when said securing means is in place and said flap is closed;

f) a first hook and loop pile fastener material strip affixed to a front surface near a top edge of said lower front wall of said box-shaped housing;

g) a second hook and loop pile fastener material strip affixed to a rear surface near a free edge of said flap, wherein when said flap is folded closed over the top and upper front portion area of said box-shaped housing, said second hook and loop pile fastener material strip will engage with said first hook and loop pile fastener material strip to hold said flap in a retained closed position;

h) a first box-shaped laundry supply container is for holding detergent and is of a height slightly lower than said side walls and said rear wall of said box-shaped housing;

i) a second box-shaped laundry supply container is for holding fabric softener and is a height of about half that of said first box-shaped laundry supply container but higher than said lower front wall of said box-shaped housing;

j) said third box-shaped laundry supply container is for holding bleach and is the same height as said first box-shaped laundry supply container;

k) said securing means comprises a box-shaped measuring cup having a raised lip extending about its mouth, a handle upon a first side wall of said box-shaped measuring cup and a scale upon a second side wall of said box-shaped measuring cup, so that when said box-shaped measuring cup is inverted and placed upon said top wall of said second box-shaped laundry supply container within said box-shaped housing, said raised lip will bear against a left side wall of said first box-shaped laundry supply container and a right side wall of said third box-shaped laundry supply container to retain all of said box-shaped laundry supply containers snugly within said box-shaped housing.

5. The tote bag as recited in claim 4, further comprising:

a) a money holder pocket attached to said rear surface of said flap; and b) a zipper for closing said money holder pocket.

6. The tote bag as recited in claim 4, further comprising:

a) a cell phone holder attached to one said side wall of said box-shaped housing; and b) a snap lid for closing said cell phone holder.

7. A method of organizing, securing and safely transporting laundry supplies in a tote bag comprising the steps of:

a) inserting a first box-shaped laundry supply container that holds detergent within a left side of a box-shaped housing of said tote bag;

b) inserting a second box-shaped laundry supply container that holds a fabric softener within center of said box-shaped housing of said tote bag next to said first box-shaped laundry supply container, wherein said second box-shaped laundry supply container is of a height about half that of said first box-shaped laundry supply container;

c) inserting a third box-shaped laundry supply container that holds bleach within a right side of said box-shaped housing of said tote bag next to said second box-shaped laundry supply container, wherein said third box-shaped laundry supply container is the same height as said first box-shaped laundry supply container;

d) placing a box-shaped measuring cup having a raised lip extending about its mouth in an inverted position onto said second box-shaped laundry supply container, so that said raised lip will bear against a left side wall of said first box-shaped laundry supply container and a right side wall of said third box-shaped laundry supply container to retain all of said box-shaped laundry supply containers snugly within said box-shaped housing of said tote bag;

e) closing a flap of said tote bag over a top and upper front portion area of said box-shaped housing; and f) grasping a strap attached at opposite ends to side walls of said box-shaped housing of said tote bag to allow a person to safely transport said box-shaped laundry supply containers within said box-shaped housing of said tote bag.

* * * * *